US007201295B1

(12) United States Patent
Sitzberger

(10) Patent No.: US 7,201,295 B1
(45) Date of Patent: Apr. 10, 2007

(54) FITMENT ASSEMBLY FOR A LIQUID DISPENSER

(76) Inventor: Carl R. Sitzberger, 7 Sequoia Ct., Springfield, IL (US) 62712

( * ) Notice: Subject to any disclaimer, the term of this patent is extended or adjusted under 35 U.S.C. 154(b) by 44 days.

(21) Appl. No.: 10/905,120

(22) Filed: Dec. 16, 2004

(51) Int. Cl.
*B65D 37/00* (2006.01)
*B65D 5/72* (2006.01)

(52) U.S. Cl. ..... 222/207; 222/214; 222/494; 222/491; 137/853

(58) Field of Classification Search .. 222/181.1–181.3, 222/100, 101, 213, 214, 209, 207, 180, 494, 222/491, 212; 137/853
See application file for complete search history.

(56) References Cited

U.S. PATENT DOCUMENTS

| | | | | | |
|---|---|---|---|---|---|
| 2,772,817 | A | | 12/1956 | Jauch | 222/207 |
| 3,087,656 | A | | 4/1963 | Dougherty | 222/518 |
| 3,107,035 | A | | 10/1963 | Cholet | 222/213 |
| 3,141,580 | A | | 7/1964 | Rogers | 222/213 |
| 3,193,154 | A | | 7/1965 | Bross | 222/207 |
| 3,244,332 | A | | 4/1966 | Rogers | 222/213 |
| 4,130,224 | A | * | 12/1978 | Norman et al. | 222/207 |
| 4,256,242 | A | * | 3/1981 | Christine | 222/207 |
| 4,349,133 | A | * | 9/1982 | Christine | 222/183 |
| 4,570,829 | A | * | 2/1986 | Allen | 222/207 |
| 4,573,612 | A | * | 3/1986 | Maddison et al. | 222/105 |
| 4,621,749 | A | * | 11/1986 | Kanfer | 222/153.01 |
| 4,635,826 | A | | 1/1987 | Hatakeyama et al. | 222/147 |
| 4,776,495 | A | | 10/1988 | Vignot | 222/207 |
| 4,886,192 | A | * | 12/1989 | Cassia | 222/181.2 |
| 4,895,276 | A | * | 1/1990 | Maldonado | 222/144.5 |
| 5,105,992 | A | * | 4/1992 | Fender et al. | 222/52 |
| 5,439,143 | A | | 8/1995 | Brown et al. | 222/185 |
| 6,053,370 | A | * | 4/2000 | Ludbrook et al. | 222/207 |
| 6,189,740 | B1 | * | 2/2001 | Wade et al. | 222/207 |
| 6,216,916 | B1 | * | 4/2001 | Maddox et al. | 222/105 |

* cited by examiner

*Primary Examiner*—Kevin Shaver
*Assistant Examiner*—Stephanie E. Tyler
(74) *Attorney, Agent, or Firm*—Head, Johnson & Kachigian

(57) ABSTRACT

A fitment assembly for a peristaltic pump dispenser. The fitment assembly includes a flexible fitment having an upper end with a radically extending lip, a lower end spaced from the upper end, at least a portion of which is conical, and a flexible portion therebetween forming a hollow chamber. A check valve is received in the conical portion of the lower end and includes a lower base, on upper cylindrical wall spaced from the lower base, and a plurality of legs extending between the lower base and the upper wall wherein pressure on the flexible portion of the fitment will force fluid in the hollow chamber between said lower base and said upper wall of said check valve and out of the lower end of the fitment.

9 Claims, 5 Drawing Sheets

FITMENT ASSEMBLY FOR A LIQUID DISPENSER

BACKGROUND OF THE INVENTION

1. Field of the Invention

The present invention is directed to a fitment assembly for a liquid peristaltic pump dispenser which will be capable of delivering a measured dosage of fluid contained in a refillable liquid container.

2. Prior Art

Various types of fluid dispensers which deliver a selected close or dosage of a liquid product are known. For example, various types of soap or alcohol based surfactants may be dispensed from dispensers which retain a refillable liquid container. The liquid container is held in a housing which includes a pivoting arm which applies pressure to a chamber or bladder in order to force the stored fluid out of the chamber or bladder, dispensing a selected or metered amount.

Various other types of dispensers and dispensing valves have been proposed in the past. U.S. Pat. No. 3,193,154 (Bross) discloses a diaphragm configuration including a bellows-portion 5a and a stem 9a (See, e.g., FIG. 7). In use, the bellows-portion is extended (as shown in FIG. 6), allowing fluid to flow through the opening 15a by withdrawing tip 20 of stem 9a from the opening 15a. In the most relevant embodiment (FIG. 7), the bellows-portion extends due to fluid pressure applied to inner wall 22.

U.S. Pat. No. 4,776,495 (Vignot) discloses a dispenser including tubular body 6 and an interior skirt 17 (See, e.g., FIG. 1). In use, force 16 applied to the body increases the pressure of fluid within the device. The increased pressure inwardly displaces a side of interior skirt 17, allowing fluid to pass.

U.S. Pat. No. 4,635,826 (Hatckeyama) discloses a valve assembly including a valve member 22 and valve sheet 30 (See, FIG. 2). In use, pressure applied to the tube body 12 increase fluid pressure in the passage 28, which forces the valve sheet 30 upward. When the sheet 30 is displaced upward, fluid is allowed to pass through passage 28, around sheet 30 and past hook portions 34, and beyond outlet 20.

U.S. Pat. No. 3,244,332 (Rogers '332); U.S. Pat. No. 3,141,580 (Rogers '580); U.S. Pat. No. 3,087,656 (Doughterty); and U.S. Pat. No. 3,107,035 (Chalet) each disclose various dispensing systems having a blocking element disposed in a dispensing tip. In use, each of these inventions involves longitudinally displacing the blocking element with respect to the dispensing tip via the lateral application of pressure to the exterior of the tip, thereby allowing fluid to pass out of the device.

U.S. Pat. No. 2,772,817 (Jauch) discloses a dispensing pump including a barrel 26 and a tip 32 having a vent 33 (See, e.g., FIGS. 1 and 2). In use, pressure applied to the sides of the barrel 26 increases fluid pressure therein. The pressure increase forces slit 33 open, thus allowing fluid to pass.

U.S. Pat. No. 5,439,143 (Brown) discloses a dispensing valve involving a container 2 and a valve 3 having a valve head 5 and a discharge orifice 6. In use, pressure within the container 2 is increased via application of force to exterior side walls 14, 15 of the container. The pressure increase causes the valve head 5 to move from a fully retracted position to an extended position (See FIGS. 10 and 11). Additional pressure to the container causes slit 6 of head 5 to open, thereby allowing fluid to pass there-through (See FIGS. 12 and 13).

While silicone has been utilized as a desirable, flexible material in fluid dispenser, it is known that it will react negatively with certain types of surfactants. Accordingly, it would be desirable to provide a dispensing system that did not include silicone components.

It would also be desirable to provide a fitment assembly for a dispenser which would deliver an accurately metered dosage of liquid and thereafter seal to prevent dripping or leaking of the fluid media.

It would be further desirable to provide a two-piece fitment assembly for a liquid dispenser that may be simply manufactured and installed.

SUMMARY OF THE INVENTION

The present invention is directed to a fitment assembly for a peristaltic pump dispenser wherein the pump dispenser includes an outer housing holding a refillable liquid container and a pivoting rocker face or plate to force a measured dosage of liquid out from the fitment assembly.

The lower end of the container terminates in an open threaded end which is connected to the fitment assembly of the present invention by an internally threaded cap.

The fitment assembly includes a flexible fitment having an upper end with a radially extending lip which assists in forming a seal with the container. The fitment also includes a lower end terminating in a tip. Between the upper end and a lower end is a conical, flexible portion which forms a hollow chamber.

A substantially, non-deformable check valve resides in a conical portion of a lower end of the flexible fitment. The check valve includes a lower base which is generally flat and solid and has a circumferential edge which mates with the lower end of the fitment. The check valve also includes an upper cylindrical wall which is spaced from the lower base. Between the lower base and the cylindrical wall are a plurality of extending legs which are arranged to form a conical surface with spaces therebetween. The exterior of the conical surfaces mates with the conical portion of the lower end of the flexible fitment.

Fluid from the container will be permitted to fill the fitment assembly by passing into the upper end of the fitment through the threaded cap. The check valve will permit fluid from passing beyond it. Accordingly, the hollow chamber will fill with fluid by gravity. Thereafter, the rocker face or plate 16 will be pushed or depressed by a user which will cause the flexible portion of the fitment to move and decrease in volume. The pressure applied with displace the flexible conical portion so that fluid will pass through the openings in the extending legs and the fluid will displaced the conical portion so that fluid passes around the exterior circumference or edge of the lower base. Thereafter, the fluid will exit out of the tip of the fitment assembly.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
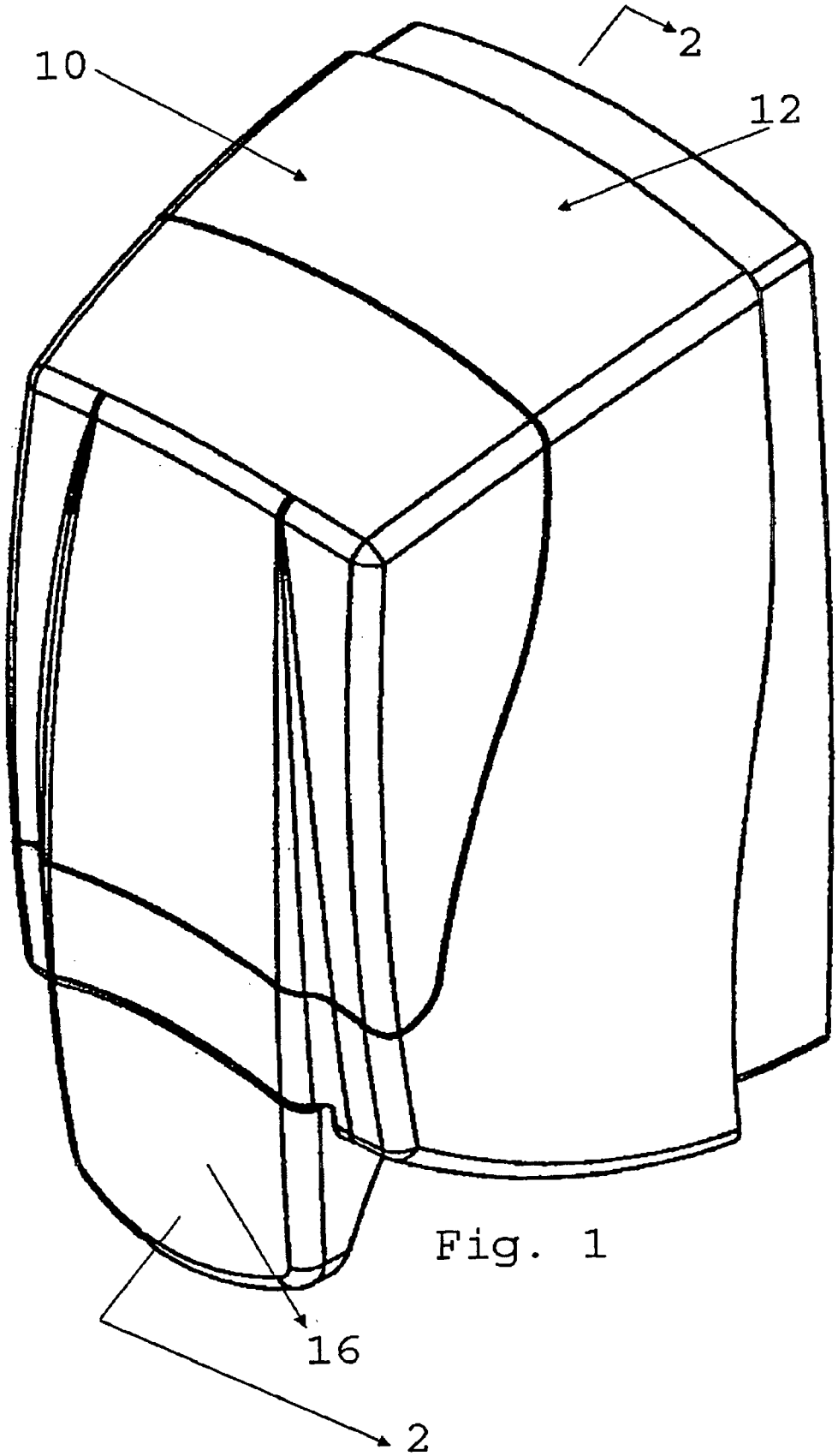
FIG. 1 illustrates a perspective view of a fitment assembly for a liquid dispenser as constructed in accordance with the present invention.

FIG. 1 illustrates a perspective view of a peristaltic pump dispenser 10 having a fitment assembly constructed in accordance with the present embodiment. The pump dispenser 10 includes an outer housing 12 which may be fixed to a wall or other surface (not shown). The outer housing 12 holds a refillable liquid container (not visible in FIG. 1).

The dispenser 10 includes a pivoting rocker face or plate 16 which will be depressed by a user in order to deliver a desired dosage.

Figure 2:
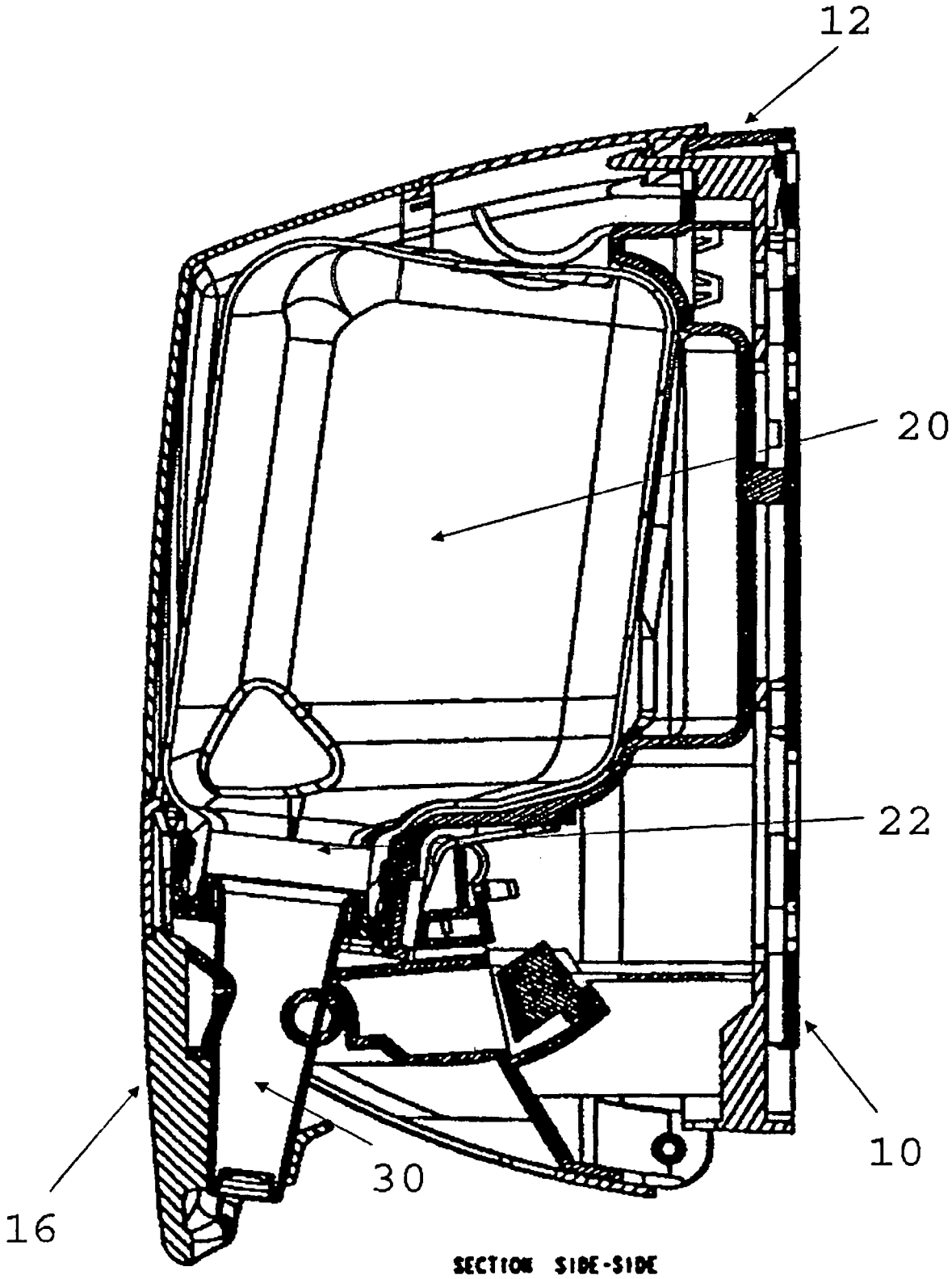
FIG. 2 illustrates a sectional view taken along section line 2—2 of FIG. 1.

FIG. 2 illustrates a sectional view taken along section lines 2—2 of FIG. 1. The refillable liquid container 20 is visible inside of the outer housing 12. The lower end of the container 20 terminates in an open threaded end 22. It will be appreciated that the fitment assembly of the present invention may be used with various types of peristaltic pump liquid dispensers.

Figure 3:
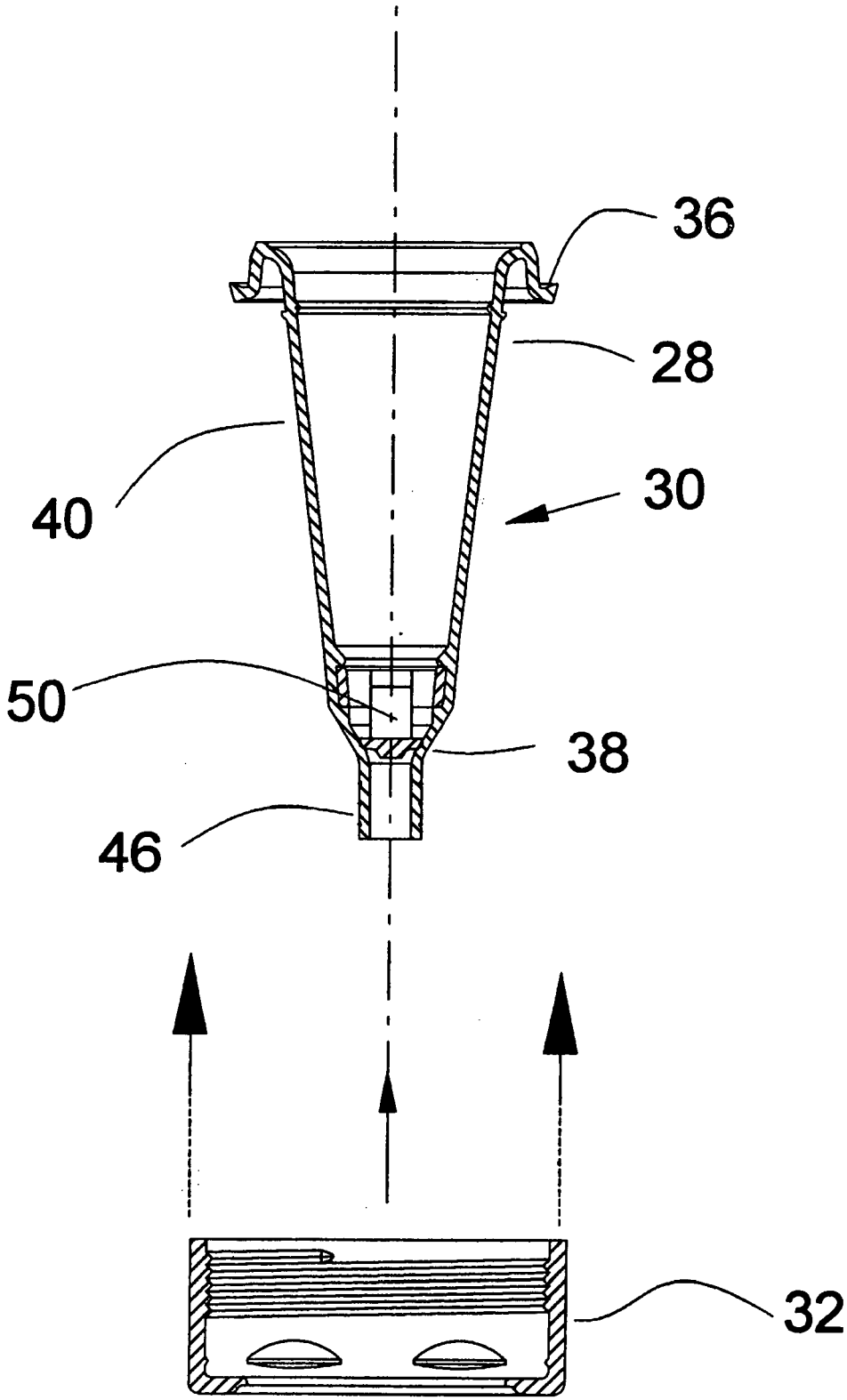
FIG. 3 illustrates a sectional view of a fitment assembly of the present invention and FIG. 3A illustrates an enlarged view of a portion of the fitment assembly.

The threaded open end 22 is connected to a fitment assembly 30 by an internally threaded cap 32 shown apart from the dispenser 10 in the exploded view shown in FIG. 3. The fitment assembly 30 includes a flexible and resilient fitment 28 composed in the present embodiment of ethylene propylene diene monomer. The flexible fitment 28 includes an upper end 36 having a radially extending lip 36 which assists in forming a seal with the container 20. The fitment also includes a lower end 38 which terminates in a cylindrical tip 46. In the present embodiment, the tip 46 has a series of external grooves so that a desired length may be selected by trimming the tip. Between the upper end 36 and the lower end 38 is a conical, flexible portion 40 which forms a hollow chamber.

A substantially non-deformable check valve 50 resides in the conical portion of the lower end 38 of the flexible fitment 28.

Figure 5:
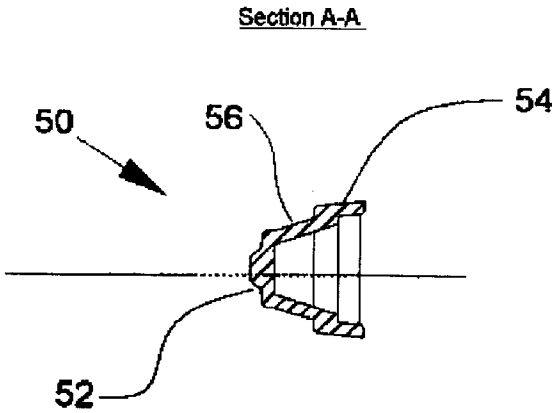
FIGS. 4, 5 and 6 illustrate alternate views of a check valve within the fitment assembly of the present invention.
Figure 6:
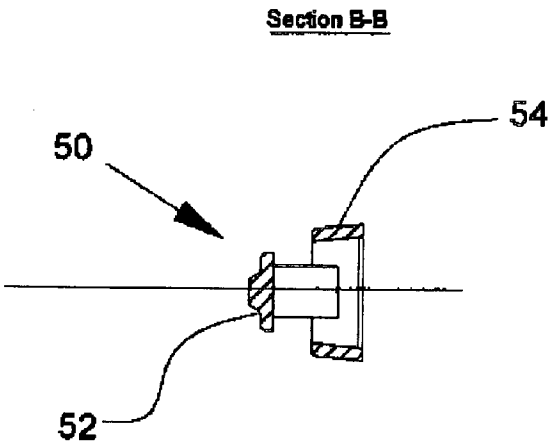
Figure 4:
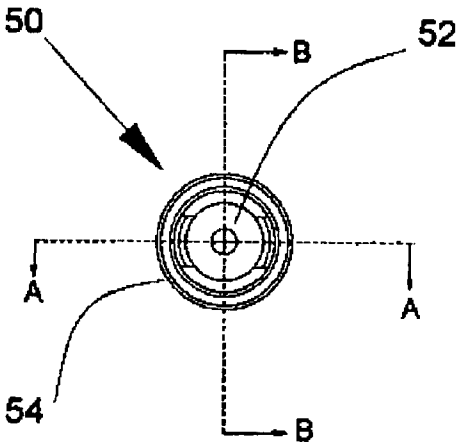

The check valve 50 is shown apart from the device in FIGS. 4, 5 and 6. FIG. 4 illustrates a bottom view of the check valve. The check valve 50 includes a lower base 52 which is generally flat and solid and has a circumferential edge which mates with the lower end of the fitment 28. The check valve 50 also includes an upper cylindrical wall 54 having open ends which is spaced from the lower base 52. Between the lower base 52 and the cylindrical wall 54 are a plurality of extending legs 56 with spaces therebetween. The legs 56 are arranged to form a conical surface with spaces therebetween. The exterior of the conical surface mates with the conical portion of the lower end of the flexible fitment.

Figure 3A:
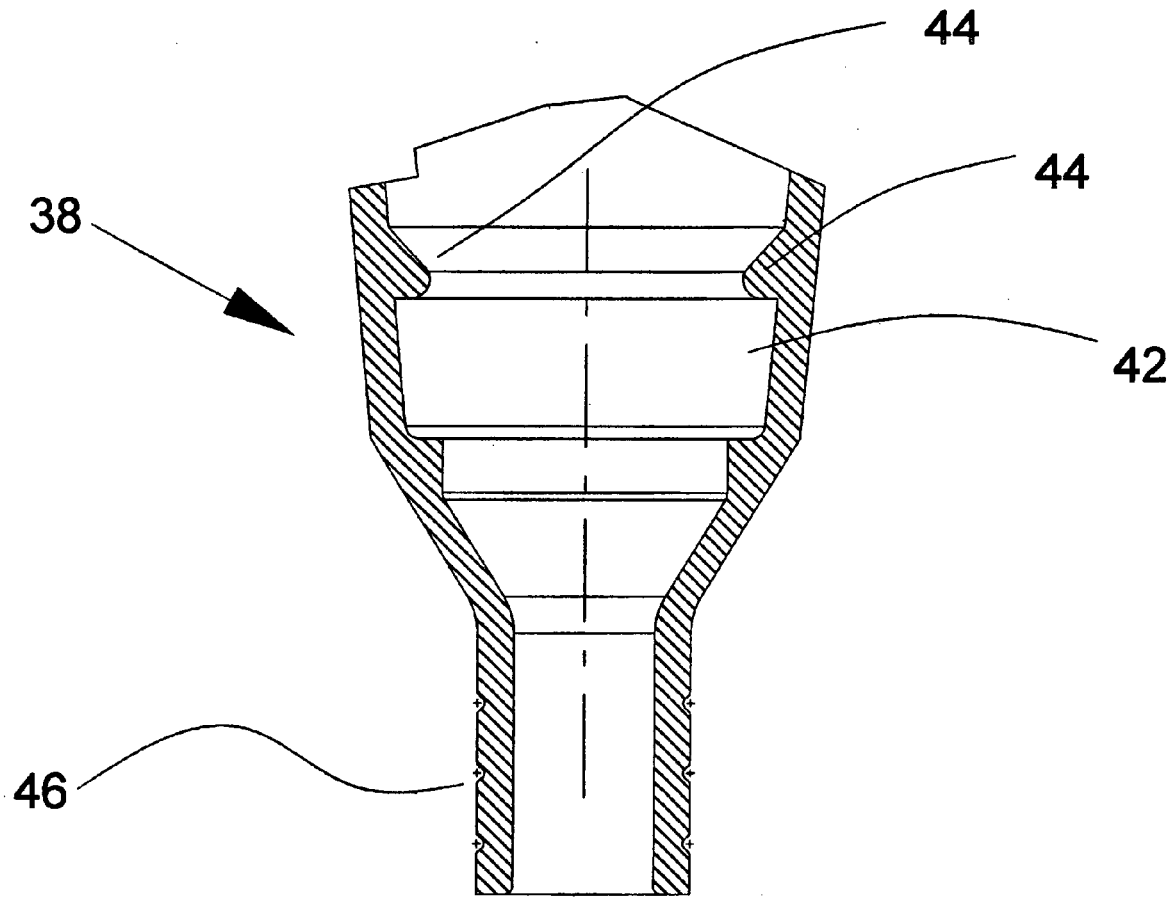

FIG. 3A is an enlarged view of the lower end 38 with the check valve removed. The upper cylindrical wall 54 resides in portion designated by numeral 42. The check valve is held in place by shoulder 44.

In operation, a desired, measured dosage of fluid from the refillable container 20 may be delivered. Fluid, such as soap, will be permitted to fill from the container 20 by passing into and through the upper end 36 of the fitment 28 through the threaded cap 32. The hollow chamber 40 will fill by gravity. Initially, the check valve 50 will stop fluid from passing beyond it. In particular, the lower base 52 forms a floor beyond which the fluid will not pass. Accordingly, the hollow chamber 40 will fill with fluid by gravity. Thereafter, the pump arm 60 will be pushed or depressed by a user which will course the flexible portion of the fitment 28 to decrease in volume. The fluid will pass through the upper cylindrical wall of the check valve. As pressure increases, the lower portion of the fitment 28 will expand allowing fluid to pass through the spaces between the plurality of extending legs 56 and around the exterior edge of the lower base 52. Thereafter, the fluid will exit out of the tip of the fitment.

Whereas, the present invention has been described in relation to the drawings attached hereto, it should be understood that other and further modifications, apart from those shown or suggested herein, may be made within the spirit and scope of this invention.

What is claimed is:

1. A fitment assembly for a liquid peristaltic pump dispenser, which assembly comprises:

a flexible fitment having an upper end with a radially extending lip, a lower end spaced from said upper end, at least a portion of which is conical, and a flexible portion there between forming a hollow chamber;

a rigid check valve having a lower base, an upper cylindrical wall spaced from said lower base, and a plurality of extending legs and a plurality of openings between said lower base and said upper wall;

wherein said plurality of extending legs and a plurality of openings between said lower base and said upper wall mate with said lower end of said fitment to form a seal; and wherein pressure on said flexible portion will force fluid in said hollow chamber through said openings between said lower base and said upper wall of said check valve and out of said lower end of said fitment.

2. A fitment assembly as set forth in claim 1 wherein said check valve is received in said conical portion of said lower end.

3. A fitment assembly as set forth in claim 1 wherein said lower end includes an extending cylindrical tip.

4. A fitment assembly as set forth in claim 1 wherein said upper end of said flexible fitment is held in place by a threaded cap having a central top opening to receive said fitment therein.

5. A fitment assembly as set forth in claim 1 wherein said threaded cap is received on a refillable liquid container.

6. A fitment assembly as set forth in claim 1 wherein said flexible fitment is fabricated from ethylene propylene diene monomer.

7. A fitment assembly as set forth in claim 1 wherein said check valve is fabricated from propylene.

8. A fitment assembly as set forth in claim 1 wherein said hollowed chamber is sized in order to deliver a desired dosage of a fluid therein.

9. A fitment assembly as set forth in claim 1 wherein said lower end of said fitment includes an inner shoulder to retain said check valve.

* * * * *